US009033111B2

(12) United States Patent
Kwon

(10) Patent No.: US 9,033,111 B2
(45) Date of Patent: May 19, 2015

(54) ELEVATOR GOVERNOR SYSTEM

(75) Inventor: YiSug Kwon, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 427 days.

(21) Appl. No.: 13/379,411

(22) PCT Filed: Jul. 20, 2009

(86) PCT No.: PCT/US2009/051147

§ 371 (c)(1),
(2), (4) Date: Dec. 20, 2011

(87) PCT Pub. No.: WO2011/010990

PCT Pub. Date: Jan. 27, 2011

(65) Prior Publication Data

US 2012/0103732 A1 May 3, 2012

(51) Int. Cl.
*B66B 1/26* (2006.01)
*B66B 5/04* (2006.01)

(52) U.S. Cl.
CPC ..... *B66B 5/044* (2013.01)

(58) Field of Classification Search
CPC ..... B66B 5/044; B66B 5/02; B66B 5/12
USPC ..... 187/305, 373
See application file for complete search history.

(56) References Cited

U.S. PATENT DOCUMENTS 3,814,216 A 6/1974 Pisatowski
4,556,155 A 12/1985 Koppensteiner
4,923,055 A 5/1990 Holland
5,310,022 A 5/1994 Sheridan et al.
5,321,216 A 6/1994 Jamieson et al.
(Continued)

FOREIGN PATENT DOCUMENTS

EP 0 499 379 A2 8/1992
EP 0 748 758 A1 12/1996
(Continued)

OTHER PUBLICATIONS

International Search Report and Written Opinion for related International Application No. PCT/US09/51147; report dated Apr. 19, 2010.
(Continued)

*Primary Examiner* — William E Dondero
*Assistant Examiner* — Diem Tran
(74) *Attorney, Agent, or Firm* — Miller, Matthias & Hull LLP

(57) ABSTRACT

A governor system for an elevator is disclosed. The governor includes a shaft horizontally extending from a sheave of the governor system. A base, spring, and slider are mounted on the shaft with linkages extending from the base of the sheave to at least one flyweight. The spring and flyweights are sized such that centrifugal force will be sufficient to overcome the biasing force of the spring upon the sheave reaching a certain rotational speed. Overspeed sensors and mechanical switches are positioned proximate the flyweights and flyweights plates such that upon such motion of the flyweights, the governor system is triggered, thereby slowing and ultimately stopping the elevator. The governor system has a greatly reduced space requirement compared to previous governors, as well as a reduced likelihood of false trips due to acceleration or deceleration of the car.

19 Claims, 6 Drawing Sheets

(56) References Cited

U.S. PATENT DOCUMENTS

| | | | | |
|---|---|---|---|---|
| 5,377,786 | A | 1/1995 | Nakagawa | |
| 5,617,933 | A | 4/1997 | Ericson | |
| 5,653,312 | A | 8/1997 | Kato | |
| 2003/0042079 | A1 * | 3/2003 | Sanchez et al. | 187/373 |
| 2010/0059319 | A1 * | 3/2010 | Aguado et al. | 187/414 |

FOREIGN PATENT DOCUMENTS

| | | | | |
|---|---|---|---|---|
| EP | 0 662 445 | B1 * | 4/1999 | |
| EP | 1 086 921 | A1 | 3/2001 | |
| EP | 1 577 248 | A1 | 9/2005 | |
| EP | 1 598 300 | A1 | 11/2005 | |
| EP | 1 086 921 | B1 | 1/2006 | |
| EP | 1 741 659 | A1 | 1/2007 | |
| EP | 1 798 183 | A1 | 6/2007 | |
| EP | 1 832 542 | A1 | 9/2007 | |
| EP | 1 852 383 | A1 | 11/2007 | |
| GB | 461186 | * | 2/1937 | |
| JP | S-51113940 | A | 10/1976 | |
| JP | H-11240677 | A | 9/1999 | |
| WO | WO-03/070615 | A1 | 8/2003 | |
| WO | WO-03/091142 | A1 | 11/2003 | |
| WO | WO 2005061362 | A1 * | 7/2005 | B66B 5/00 |
| WO | WO-2008/125133 | A1 | 10/2008 | |

OTHER PUBLICATIONS

Office Action in related Japanese Application No. 2012-521603; action dated Aug. 27, 2013.

* cited by examiner

ELEVATOR GOVERNOR SYSTEM

CROSS-REFERENCE TO RELATED APPLICATIONS

This application is a U.S. national stage filing of International Patent Application No. PCT/US09/51147, filed on Jul. 20, 2009.

FIELD OF THE DISCLOSURE

The present disclosure generally relates to elevators and, more particularly, relates to safety systems for governing or limiting the speed of an elevator.

BACKGROUND OF THE DISCLOSURE

Elevators are essential devices for moving passengers and cargo up and down within tall buildings. In order to operate elevators safely, a number of safety devices have been employed and improved over the years. One of those systems is referred to as a governor. Governors are constructed such that if the elevator car surpasses a predetermined safe speed, the governor will engage to slow down and ultimately stop the car from further movement. This can be accomplished by engaging a wedge or other type of a mechanical brake as will be further described herein.

One known type of governor is referred to as a pendulum-type governor. With a pendulum type governor, a sheave is mounted on a horizontal shaft provided at the top of a hoistway in which the machine elevator is operated. A cable, rope, belt or the like is operatively connected from the sheave to the elevator car itself. In addition to the sheave, the shaft is connected to a gearbox, which in turn is connected to a vertically oriented shaft. First and second pendulums are connected by linkages to the vertical shaft. If the elevator car increases in speed, the rotational speed of both shafts increases as well. The pendulums are spring biased into a non-extended position, but when the elevator car surpasses a predetermined speed, the biasing force of the spring will be overcome and the pendulums will swing outwardly, thereby causing the governor to engage. This may be accomplished by first locking the sheave and rope against further motion. Once the rope stops and the elevator car continues to move, the rope pulls up on a safety gear, thereby causing a wedge-type friction roller, solid plate, or the like to clamp very tightly on running guides of the elevator car. While effective, pendulum-type governors do have a significant space requirement given the need for the vertical shaft and gearbox.

Another type of governor is known as a flyweight-type governor. With a flyweight-type governor, a plurality of flyweights are eccentrically mounted about the shaft of the sheave, and connected by spring-biased linkages. As the sheave and flyweights rotate, centrifugal force tends to cause the flyweights to pivot radially outwardly. The spring is sized such that its biasing force is overcome when the sheave rotates beyond a predetermined safe speed and thus the generated centrifugal force is greater than the spring biasing force. When this happens the governor engages to slow and ultimately stop the elevator car in a manner similar to a pendulum-type governor. While more compact than pendulum-type governors, flyweight-type governors are more prone to false trips, and thus unnecessary stoppages of the elevator. More specifically, due to the center of gravity of the flyweights not being aligned with the center of gravity with the sheave, flyweight-type governors are very sensitive to false trips caused by high acceleration or deceleration of the car even when the overall speed of the car has not exceeded the predetermined safe velocity.

It can therefore be seen that a need exists for an elevator governor with lessened space requirements compared to pendulum-type governors, and with a decreased propensity toward false trips compared to flyweight-type governors.

SUMMARY OF THE DISCLOSURE

In accordance with one aspect of the disclosure, an elevator governor is therefore disclosed. The elevator governor may comprise a sheave rotatably mounted on a shaft and operatively connected to an elevator car, a flyweight retractably mounted on the shaft, the sheave and the flyweight both including a center of gravity, the center of gravity of the sheave always being aligned with the center of gravity of the flyweight, a biasing element exerting a radially inward force on the flyweight, and at least one sensor mounted proximate the flyweight.

In accordance with another aspect of the disclosure, another elevator governor is disclosed which may comprise a sheave rotatably mounted proximate an elevator car and operatively connected to the elevator car, a shaft extending from the sheave, a base mounted on the shaft, a slider mounted on the shaft, a spring mounted on the shaft, a flyweight connected to the slider and the base by a linkage, a flyweight plate connected to each flyweight, and at least one sensor mounted proximate the flyweight plate.

These and other aspects and features of the present disclosure will be more apparent upon reading the following detailed description when taken in conjunction with the accompanying drawings.

Figure 1:
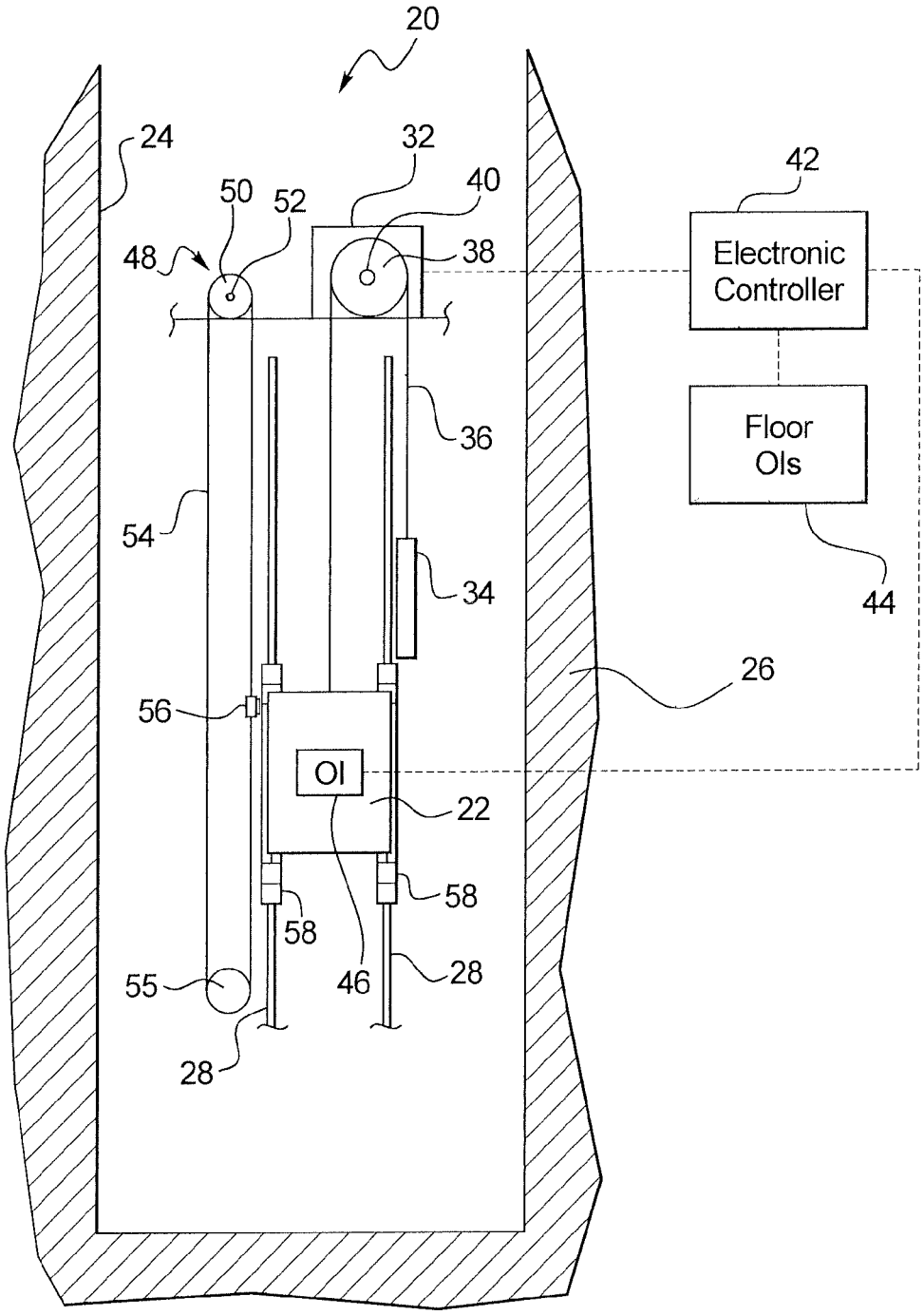
FIG. 1 is a schematic representation of an elevator system constructed in accordance with the teachings of the disclosure.

While the present disclosure is susceptible to various modifications and alternative constructions, certain illustrative embodiments thereof have been shown in the drawings will be described below in detail. It should be understood, however, that there is no intention to be limited to the specific forms disclosed, but on the contrary, the intention is to cover all modifications, alternative constructions, and equivalents falling within the spirit and scope of the present disclosure.

DETAILED DESCRIPTION OF THE DISCLOSURE

Referring now to the drawings, and with specific reference to FIG. 1, an elevator system is generally referred to by reference numeral 20. As shown therein, the elevator system 20 is provided to move an elevator car 22 up and down within a hoistway 24 of a building 26. In order to do so, the elevator car may be guided on rails 28 and connected by way of cables 30 to a motor 32 typically divided at the top of the hoistway 24. To provide for smooth and safe movement of the elevator car 22, the car 22 is in turn connected to a counterweight 34 by way of cables 36. The motive force to drive the elevator car 22 may be provided by the motor 32 connected to a main sheave 38 by a driveshaft 40. An electronic controller 42 may be connected to the motor 32 to control operation of the elevator system 20 based on input received from operator interface modules 44 provided on each floor of the building 24, operator interface 46 provided on the car 22, and various sensors as herein described. It is important to note that, any number of different configurations can be used to operate the elevator system 20, with the components of FIG. 1 being merely exemplary and setting the background for the remainder of this disclosure.

In order to provide a safety mechanism to ensure the elevator car 22 does not surpass a certain speed, a governor 48 may be provided. The governor 48 is conventionally mounted at the top of the hoistway 24, but as will be shown in further detail herein due to the unique teaching of the present disclosure and its relatively small size, the governor 48 of the present disclosure can be mounted in other positions as well.

The governor 48 may include a pulley or sheave 50 mounted on a horizontal shaft 52. The sheave 50 may in turn be connected to the elevator car 22 by a cable, belt, or rope 54 itself trained around a bottom pulley 55. Accordingly, as the car 22 moves, so does the cable 54, as well as the shaft 52 and the sheave 50, which rotate. If the sheave 50 rotates beyond a predetermined velocity, the governor 48 will function so as to stop the sheave 50 from rotating. This will in turn cause a safety 56, such as a wedge-type friction shoe or plate, to be engaged which will clamp down very tightly on elevator running guides 58 slidably mounting the car 22 on the rails 26.

Figure 3:
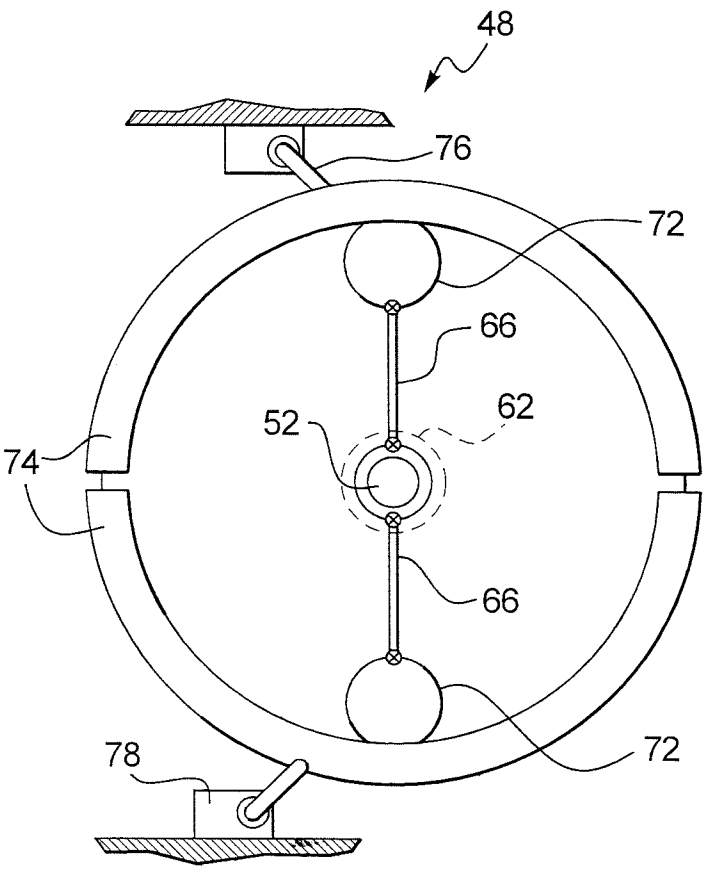
FIG. 3 is a schematic front view of the governor of FIG. 2.
Figure 2:
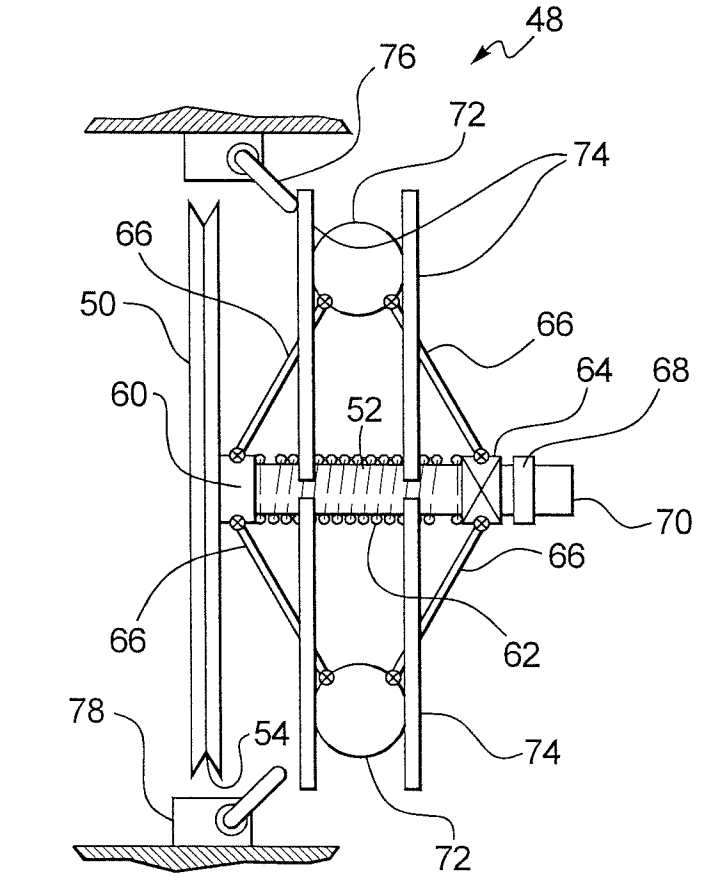
FIG. 2 is a schematic side view of a governor constructed in accordance with the present disclosure and shown in a non-tripped position.

Referring now to FIG. 2, a first embodiment of a governor 48 constructed in accordance with the teachings of the present disclosure is shown in further detail. In the depictions of FIGS. 2 and 3, the governor 48 is shown in a non-tripped position, i.e., an operating position. As shown, the governor 48 includes the aforementioned sheave 50 with horizontal shaft 52 extending therefrom. Mounted onto to the shaft 52 may be a base 60, a spring 62 and a slider 64 as will be described in further detail herein. The base 60 is fixedly mounted to the shaft 52 so as to rotate therewith and not be laterally moveable upon the shaft 52. The slider 64, on the other hand, while rotating on the shaft 52 by way of linkages 66 is free to laterally slide along the shaft 52. A fixture such as a stopper 68 may be provided at a distal end 70 of the shaft 52 so as to define a range of motion for the slider 64.

Hingedly extending from the base 60 and slider 64 may be a plurality of the linkages 66. The linkages 66 are in turn connected to one or more flyweights 72. The flyweights 72 include significant mass such that upon rotation of the sheave 50, the shaft 52 and the base 60 will tend to cause the flyweights 72 to move radially outwardly due to centrifugal force. Given the linkages 66 between the flyweights 72 and the slider 64, radially outwardly motion of the flyweights 72 will in turn cause the slider 64 to move toward the base 60 thereby compressing the spring 62. The spring 62 is manufactured so as to have a biasing force sufficient to resist such motion until the sheave 50 rotates at a predetermined speed.

Figure 5:
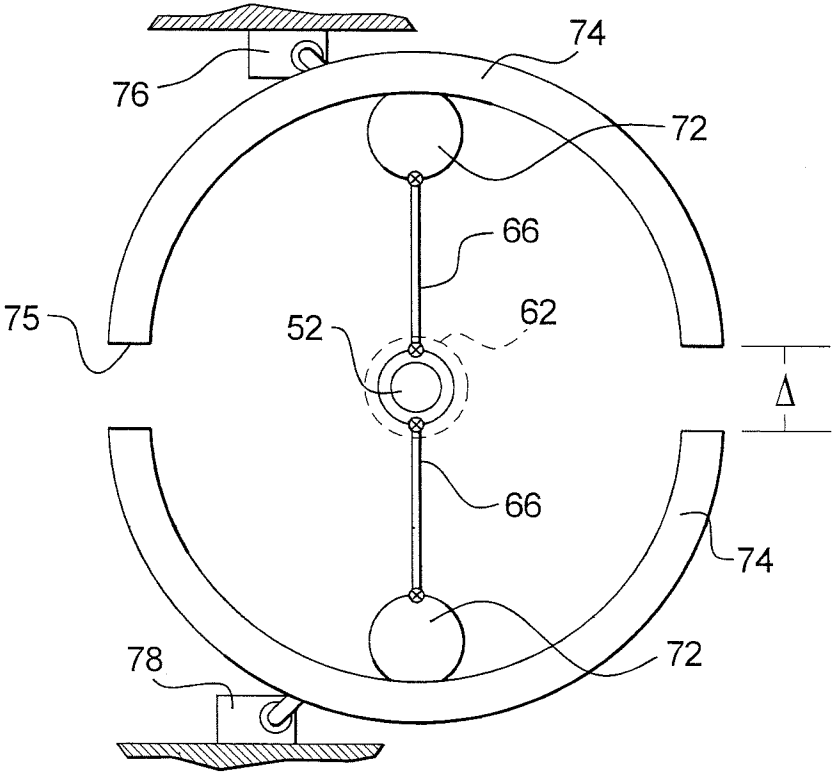
FIG. 5 is a front view of the governor of FIG. 4.
Figure 4:
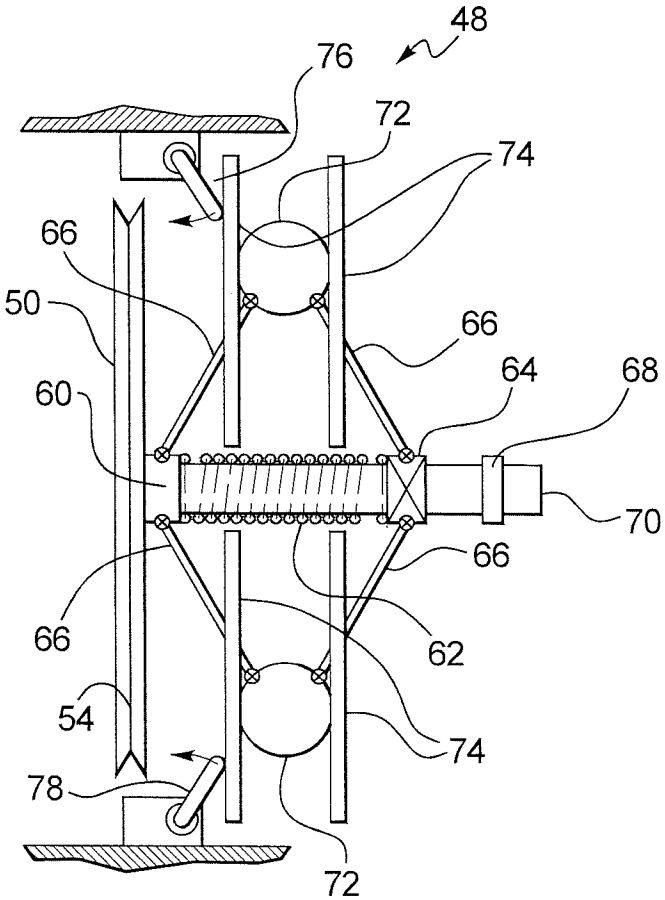
FIG. 4 is a schematic representation of the governor of FIG. 2, but shown in a tripped position.
Figure 6:
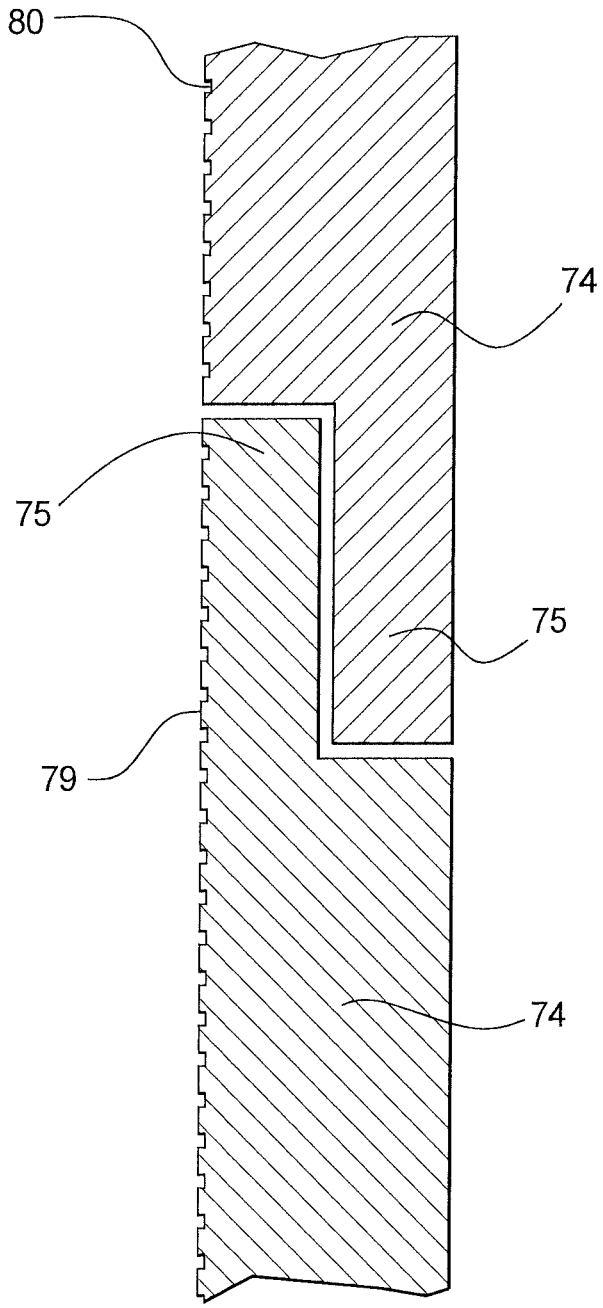
FIG. 6 is an enlarged sectional view of flyweight plates alternatively constructed in accordance with the teachings of this disclosure.

In order to enhance the function and reliability of the governor 48, at least one flyweight plate 74 is fixably attached to each flyweight 72. As shown best in FIG. 3, each flyweight plate 74 may be formed into a semicircular band. In the embodiment of FIGS. 2 and 3, first and second flyweights 72 are provided and thus first and second flyweight plates 74 are provided. In the non-tripped position, in can be seen that the flyweight plates 74 are positioned so as to practically form a complete circle or 360° circumference. Even in a tripped position of FIGS. 4 and 5, the flyweight plates only move radially apart a small distance Δ, thereby avoiding the formation of any significant window of rotation where the sensors of the governor 48 would not be engaged. In a further embodiment, shown in FIG. 6, each flyweight plate 74 can be provided with a stepped end 75, such that even as the flyweight plates 74 move radially apart, the plates 74 can combine to continue to form a complete circle, thereby avoiding the formation of any open window around the arc of the circle where the engagement of the governor would be delayed.

Referring again to FIGS. 4 and 5, as the governor 48 increases speed such that the centrifugal force generated on the flyweights 72 overpowers the biasing force of the spring 62, the slider 64 moves laterally inward toward the base 60 and thus compresses the spring 62. This in turn causes the flyweights 72 to move radially outwardly and, as they are fixedly attached to flyweights 72, this will cause the flyweights 72 to move radially outwardly as well. However, as the base 60 is fixed and the slider 64 moves radially inwardly toward the base 60, this causes the flyweights 72 and flyweight plate 74 to not only move radially outwardly, but laterally inwardly toward the base 60 as well.

Upon the governor 48 reaching a predetermined velocity, the centrifugal force generated will be sufficiently high so as to cause the flyweights 72 and flyweight plates 74 to move laterally inwardly to a degree sufficient to engage an overspeed sensor or switch 76. Once the overspeed sensor 76 is triggered, the controller 42 will be activated so as to slow down the elevator car 22 in a safe fashion. As a second level of safety, a mechanical trip switch 78 may also be provided proximate the sheave 50. As shown the best in FIGS. 2 and 4, the overspeed sensor 76 may be mounted above the sheave 50 with the mechanical switch 78 being mounted below, but in alternative embodiments, the sensors can be differently mounted. In addition, in FIGS. 2 through 5, the overspeed sensor switch 76 is mounted laterally closer to the flyweight plates 74 than the mechanical switch 78 so as to be triggered first. In alternative embodiments, the sensors can be differently mounted or the sensors themselves can have differently sized trigger arms so as to be activated in desired sequence. In addition, portions of the flyweight plates 74 can be provided with textured surfaces 79 so as to enhance the sensitivity, and ensure the engagement, of the governor 20. Such textured surfaces 79, shown in FIG. 6, may be provided in the form of grooves, ridges, cogs or the like machined into the side 80 proximate the overspeed sensor 76 and mechanical trip switch 78.

By mounting the base 60, spring 62 and slider 64 on the shaft 52, and connecting the flyweights 72 and flyweight plates 74 to the base 60 and slider 64, the need for a vertically extending shaft and gearbox to connect the two is avoided. This in turn greatly reduces the space requirements of the present disclosure compared to conventional pendulum-type governors. In addition to mounting the flyweights 72 and flyweight plates 74 uniformly around the shaft 52 with symmetrical linkages 66, the center of gravity of the sheave 52 and the center of gravity of the flyweights 72 is always exactly aligned. This in turn will greatly reduce the number of false trips due to acceleration or deceleration of the elevator compared to conventional flyweight-type governors.

Figure 7:
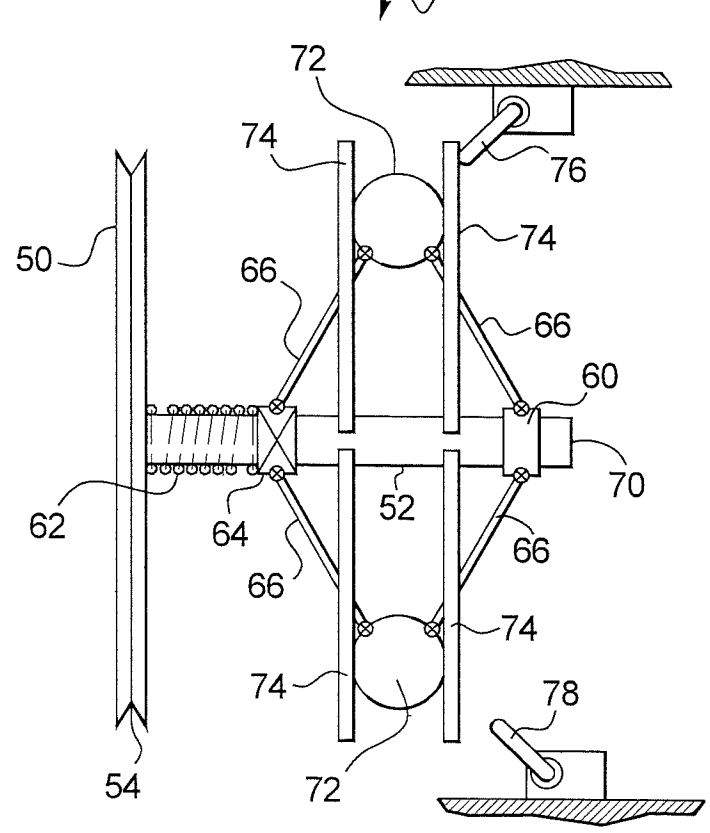
FIG. 7 is a schematic representation of a $2^{nd}$ embodiment of a governor constructed in accordance with the teachings of the present disclosure.

Referring now to FIG. 7, a second embodiment of the present disclosure is shown. Many of the features of the second embodiment are exactly the same as the first embodiment of FIGS. 2 through 5. However, with the second embodiment, the orientation of the base 60, the spring 62, and the slider 64 are altered. More specifically, the spring 62 is provided directly proximate the sheave 50 with the slider 64 being proximate the spring 62 and the base 60 being mounted next to the distal end 70 of the shaft 52. In addition, the spring 62 in this embodiment may be a tension spring fixably secured to both the sheave 50 and the slider 64. In other words, the biasing force of the spring 62 tends to pull the slider 64 toward the sheave 50. Only when the centrifugal force generated is sufficiently high so as to cause the flyweights 72 to move radially outwardly, is the biasing force of the tension spring 62 overcome, thereby causing the slider 64 to move radially away from sheave 50. In addition, as the orientation of the respective parts is altered in the second embodiment, so too are the positioning of the overspeed sensor 76 and/or the mechanical switch 78.

Figure 8:
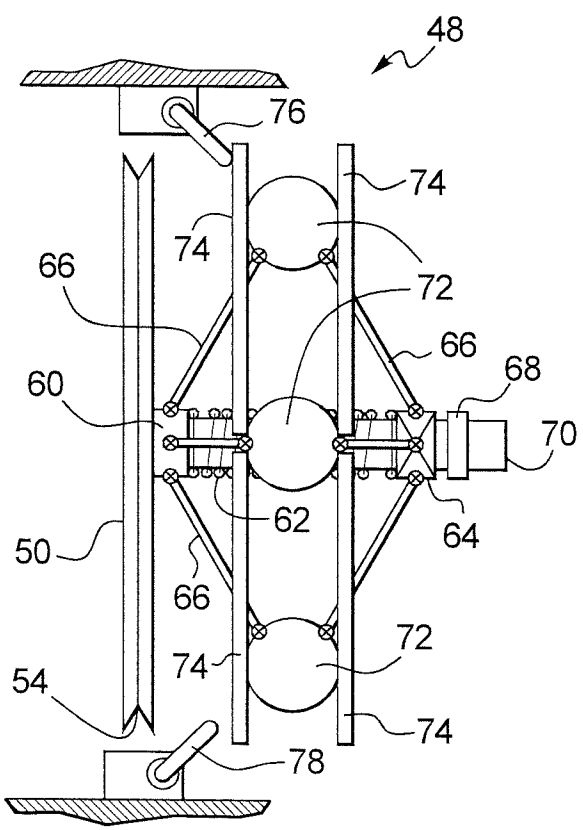
FIG. 8 is a schematic representation of $3^{rd}$ embodiment of a governor constructed in accordance with the teachings of the disclosure.

Referring now to FIG. 8, a third embodiment of the present disclosure is shown. Here, the orientation of the base 60, the spring 62 and the slider 64 are exactly the same as that of the first embodiment, but a greater number of flyweights 72 are provided. By distributing more flyweights 72 around the circumference of the governor 48, greater centrifugal force will be generated upon rotation of the system and thus the sensitivity of the governor itself will increase. While four (4) flyweights 72 are depicted in FIG. 8, it is to be understood that any number of flyweights 72 ranging from one to infinity could be included with any embodiment of the present disclosure.

Figure 10:
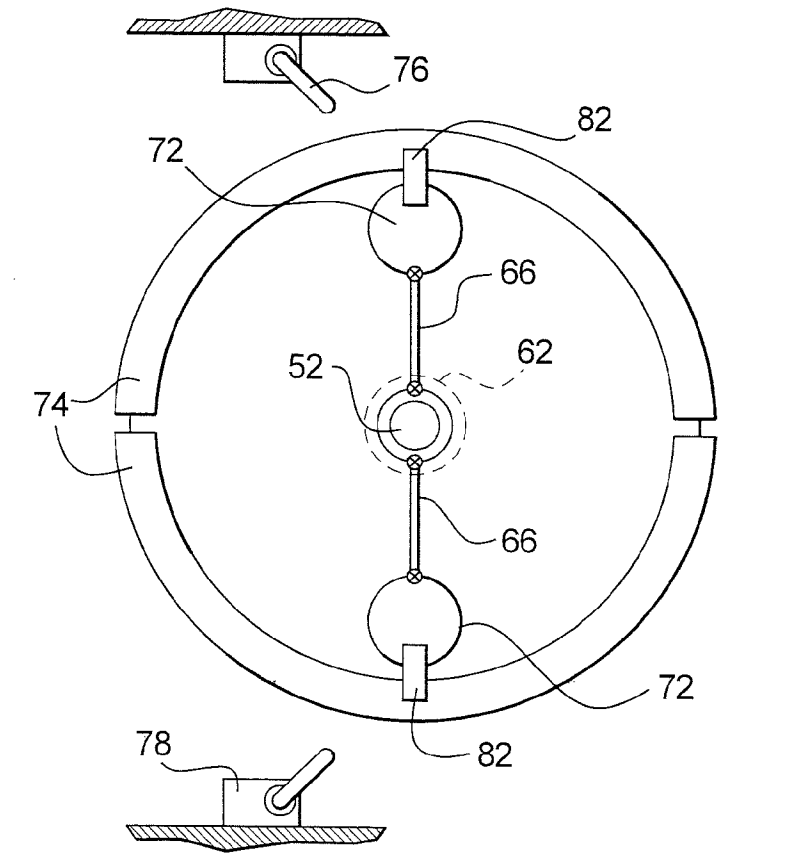
FIG. 10 is a front view of the governor of FIG. 9.
Figure 9:
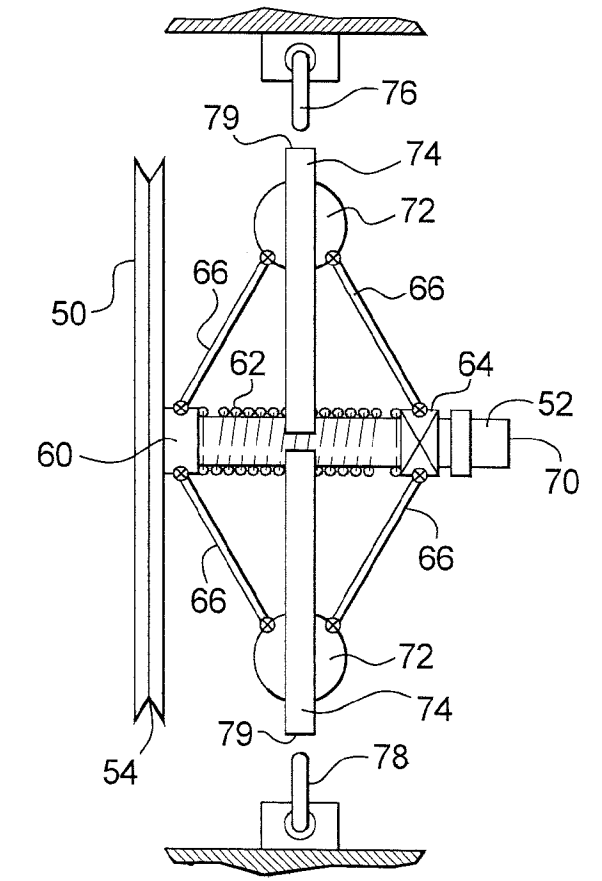
FIG. 9 is a schematic representation of a $4^{th}$ embodiment of a governor constructed in accordance with the teachings of the disclosure.

Referring now to FIG. 9, a fourth embodiment of the present disclosure is depicted. As shown therein, the orientation of the base 60, the spring 62, and the slider 64 on the shaft 52 are identical to that of the first embodiment, as are the orientations of the linkages 66 and the flyweights 72. However, as opposed to mounting the flyweight plates 74 laterally with respect to flyweights 72, the flyweight plates 74 are mounted radially outwardly from the flyweights 72. As shown best in FIG. 10, this could be accomplished by way of an additional bracket 82 or the like. Accordingly, a lesser number of flyweights plates 74 can be employed. FIGS. 9 and 10 also show that in such an embodiment, the overspeed sensor 76 and mechanical switch 78 could be mounted directly radially outwardly from the flyweight plates 74 to accommodate the slightly different ranges of motion of the flyweight plates 74 in the fourth embodiment. In addition, similar to the previous embodiments, the flyweight plates 74 could be provided with a textured surface 80. However, in the fourth embodiment the textured surface would be provided on the radially outer edge of the flyweight plates 74.

Based on the foregoing, it can be seen that the present disclosure sets forth a governor system for an elevator with a reduced size requirement compared to prior pendulums governors, but with a decreased likelihood of false trips due to unavoidable and unpredictable acceleration and deceleration levels associated with flyweight-type governors. This is due in part to the mounting of the flyweights of the present disclosure such that their centers of gravity are always in direct alignment with the center of gravity of the governor sheave.

What is claimed is:

1. An elevator governor, comprising:
- a sheave rotatably mounted on a shaft and operatively connected to an elevator car;
- a flyweight retractably mounted on the shaft, the flyweight being connected to a semi-circular band, the sheave and the flyweight both including a center of gravity, the center of gravity of the sheave being aligned with the center of gravity of the flyweight;
- a base and a slider mounted on the shaft;
- a biasing element exerting a radially inward force on the flyweight toward the shaft; and
- a sensor mounted proximate the flyweight.

2. The elevator governor of claim 1, further including at least two flyweights each being connected to a semi-circular band.

3. The elevator governor of claim 2, wherein the two semi-circular bands form a circle with overlapping ends.

4. The elevator governor of claim 2, wherein each semi-circular band includes textured surface.

5. The elevator governor of claim 1, wherein the shaft is mounted horizontally.

6. The elevator governor of claim 1, further including a second sensor mounted proximate the flyweight.

7. The elevator governor of claim 1, wherein the spring biases the base and slider apart.

8. An elevator governor, comprising:
- a sheave rotatably mounted proximate an elevator car, and operatively connected to the elevator car;
- a shaft extending from the sheave;
- a base mounted on the shaft;
- a slider mounted on the shaft;
- a spring mounted on the shaft;
- a flyweight connected to the slider and the base by a linkage;
- a flyweight plate directly connected to the flyweight; and
- a sensor mounted proximate the flyweight plate.

9. The elevator governor of claim 8, further including at least two flyweights.

10. The elevator governor of claim 9, where the flyweight plate is semi-circular in shape.

11. The elevator governor of claim 10, further including first and second flyweight plates each being semi-circular in shape.

12. The elevator governor system of claim 11, wherein the first and second flyweight plates include overlapping ends so as to form a complete circle.

13. The elevator governor of claim 8, further including first and second sensors mounted proximate the flyweight plate.

14. The elevator governor of claim 8, wherein the spring is mounted between the base and the slider.

15. The elevator governor of claim 8, wherein the spring is mounted between the slider and the sheave.

16. The elevator governor of claim 8, wherein the flyweight plate includes a textured surface adapted to engage the sensor.

17. The elevator governor system of claim 8, wherein the sensor is mounted so as to be engaged upon lateral movement of the flyweight plate.

18. The elevator governor system of claim 8, wherein the sensor is mounted so as to be engaged upon radial movement of the flyweight plate.

19. The elevator governor system of claim 8, wherein the flyweight and the sheave both include a center of gravity, the center of gravity of the flyweight always being aligned with the center of gravity of the sheave.

* * * * *